United States Patent [19]

Riback et al.

[11] Patent Number: 4,629,841

[45] Date of Patent: Dec. 16, 1986

[54] ATTITUDE CONTROLLED FLOAT SWITCH

[75] Inventors: Richard Riback, Highland Park; Brian Lau, Chicago; Paul Gergets, Oak Lawn, all of Ill.

[73] Assignee: Expert Corporation, Chicago, Ill.

[21] Appl. No.: 654,301

[22] Filed: Sep. 24, 1984

[51] Int. Cl.[4] ..... H01H 35/18

[52] U.S. Cl. ..... 200/153 A; 200/153 T; 200/84 R; 200/61.52

[58] Field of Search ..... 200/153 T, 153 A, 61.52, 200/61.53, 61.48–61.51, DIG. 29, 84 R, 51.45 R, 277, 329, 330

[56] References Cited

U.S. PATENT DOCUMENTS

| | | | |
|---|---|---|---|
| 2,296,053 | 9/1942 | Porter et al. | 200/61.52 |
| 2,642,507 | 5/1953 | West | 200/84 R |
| 3,483,741 | 12/1969 | Reichensperger | 200/84 R |
| 3,746,035 | 7/1973 | Singer | 200/84 R |
| 3,753,474 | 8/1973 | Dillmann | 200/61.52 X |
| 3,944,770 | 3/1976 | Pepper | 200/84 R |
| 4,104,492 | 8/1978 | Pliml, Jr. | 200/153 A X |

*Primary Examiner*—Stephen Marcus
*Assistant Examiner*—Ernest G. Cusick
*Attorney, Agent, or Firm*—Laff, Whitesel, Conte & Saret

[57] ABSTRACT

A hermetically sealed float switch having a bistable ball cage therein. The ball cage is free to pivot between either of two spring biased, over center positions responsive to the position of a ball which is free to roll from either end of the race through the cage to the other end of the race. An over center spring holds the ball cage in its last operated position. A safety arm prevents the ball cage from changing its attitude in any manner which, if uncontrolled, might permit the ball to escape into an inoperative position which might capture it behind the ball cage. Adjustment is provided for the on and off levels of the switch responsive to tether length.

17 Claims, 13 Drawing Figures

ATTITUDE CONTROLLED FLOAT SWITCH

This invention relates to float responsive switches and, more particularly, to float responsive switches which open or close an electrical circuit in a power device responsive to changes in the attitude of the switch.

In the past, many diffferent kinds of float operated switches have been used, especially to control electrical circuits responsive to changes in the level of a body of liquid. An example of such usage is found in a sump pump which switches on when the level of liquid in a sump reaches a certain high level and switches off when it is pumped down to a certain low level.

One of the presently available types of float switches consists of a buoyant float element attached to the lower end of a rod. The rod has two spaced-apart collars attached thereto, which are adapted to trip the two position on-off switch of the motor of a sump pump. The lower collar trips the switch to its "on" position as the water level and float rises, and the upper collar trips the switch to its "off" position when the rod and float descends under the influence of a lower water level as the pump removes water from the sump. The distance between the two collars can be adjusted to alter the differential between "on" and "off", whereby the pump will not be turned on until the water level reaches a pre-determined high level, and the pump withdraws water until a second, lower water level is reached.

If the switch system as described above cannot be used, an attitude float may open or close a switch in response to changes in float switch orientation which occur as the level of the water changes. For example, a journaled float switch may rotate around a stationary horizontal shaft, hanging down below the shaft on a low water level and rising above the shaft on a high water level. There are problems if the float switch is used under conditions where an improper torque is created in the journal. For example, if the float switch wants to twist as it raises, its supporting journal may bind. Enough resistance could be created to prevent the desired float action. Even if the switch should operate, it would be totally unsatisfactory if that operation should occur only after an overflow of an acceptable high water level.

Accordingly, an object of the invention is to provide an attitude controlled float switch which operates reliably in almost any orientation, regardless of any torque which may be exerted upon the switch.

Here, an object is to provide a fail safe feature which insures operation and preserves the integrity of the switch regardless of how it may be oriented. In this connection, an object is to provide a gravity operated ball controlled switch with a fail safe means for insuring a synchronism between the positions of a ball and a means for responding to the position of the ball.

In keeping with an aspect of the invention, these and other objects are accomplished by a hermetically sealed float switch having a bistable action, ball cage therein. The ball cage is free to pivot between either of two over center positions responsive to the position of a gravity operated ball which rolls through the cage. After it is pivoted, an over center spring holds the ball cage in its last operated position. A safety arm prevents the bistable acting ball cage from pivoting and changing its attitude in any manner which, if uncontrolled, might permit the ball to escape into an inoperable position.

Because the float switch of the present invention is connected to the power device controls by an elongated, flexible tether, the water level differential between "on" and "off" positions of the power device can be adjusted by lengthening or shortening the length of the tether.

An embodiment of the invention for accomplishing these and other objects is shown in the attached drawings wherein.

Figure 1:
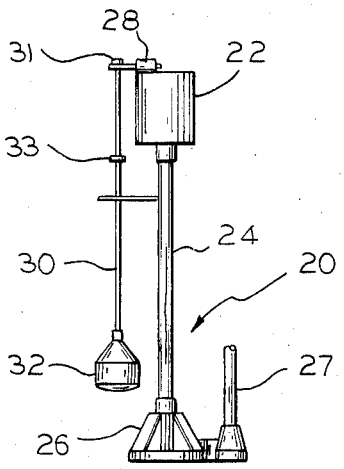
FIG.1 (PRIOR ART)
FIG. 1 is a side elevation of an exemplary prior art sump pump with a conventional rod type float switch.

In greater detail, FIG. 1 shows a more or less typical prior art sump pump 20 having a motor 22 on one end of a vertical support pipe 24 and an impeller 26 on the other end of that pipe. When the impeller is turning, water is pumped from the area at the bottom of the sump pump, up the pipe 27, and to any suitable drain for carrying away the pumped water.

An on-off switch 28 is positioned on top of the motor 22 and is spring biased to close a circuit for energizing it. A rod 30 is fastened to the switch 28 to hold it in an open position, against the bias of the spring and under the weight of float 32. A pair of collars 31, 33 are fixed on rod 30 at a given distance apart. Float 32 is lifted, as the level of the water rises, until it is high enough whereby collar 33 contacts switch 28. At that point, the collar 33 closes the switch to energize the motor 22, which turns the impeller 26 to pump the water down to a level at which collar 31 contacts switch 28, causing the switch to open. This apparatus permits adjustment of the differential between the "on" and "off" levels by altering the collar stop positions on float rod 30.

There may be many reasons why the float controlled switch of FIG. 1 should not be used. Possibly, the sump pump is entirely submerged so that such a switch and float combination cannot be used.

Regardless of the reasons why the switch 28, rod 30 and float 32 combination of FIG. 1 is not used, one alternative is to provide a completely sealed unit (FIG. 2) which rotates about a support responsive to changes in water level. More particularly, a float switch 36 may move between a low attitude A and a high attitude B (shown by dashed lines). In this prior art device, a horizontal rod or shaft support 34 is positioned in or near the median surface of the water or other fluid. The float switch 36 includes an arm 38 having a proximal end journaled on the shaft support 34. A floating box-like device 40 is hermetically sealed in a suitable rubber or plastic jacket, at the distal end of arm 38.

Figure 2:
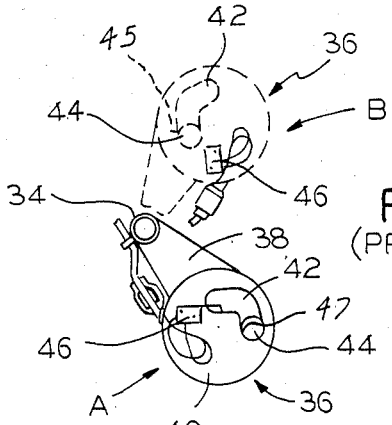
FIG.2 (PRIOR ART)
FIG. 2 is a cross sectional view of an alternative prior art float switch, having a pivotal action, which may be used in place of the float switch of FIG. 1.

Inside the box 40 is a somewhat angular or crescent shaped race 42 containing a ball bearing 44. When the water level is low, the box 40 floats at a low level (attitude A) shown by solid lines. In this low attitude, the ball bearing is in an outside end 47 of the crescent race 42. Associated with the other end of the crescent race is a miniature switch 46 which is open because it is not affected by the absent ball. As the water level rises, the box 40 floats to a high attitude B (shown by dashed lines) and the ball bearing rolls to an inside end 45 of race 42. At this point, the ball engages and operates the miniature switch 46, which closes contacts to operate a pump. As the pump evacuates the water, the float returns to the low attitude A and the ball bearing returns to position 47 to open miniature switch 46 and shut off the motor. An example of the type of device illustrated in FIG. 2 is disclosed in U.S. Pat. Nos. 3,944,770 and 4,021,145.

The difficulty with the arrangement of FIG. 2 is that the journal and supporting shaft 34 may bind if any twisting torque is applied thereto by the actions of the float. Also, a hard water deposit might build up within the journal to interfere with free pivoting. Also, this device is not adjustable with regard to liquid level differentials. A way around these problems is to simply tether the float on the end of a flexible wire or rope and to allow it to float to any attitude it wants to assume as the water level rises or lowers. This tethered operation is accomplished by substituting a completely flexible member for the arm 38. Then, the problem is to insure that the ball moves through the race responsive to the movement of the float between high and low water levels, regardless of how the float may orientate itself. This cannot be done reliably with the device of FIG. 2 because the crescent race 42 must be correctly oriented in a vertical plane, as shown in FIG. 2, for the switch to operate reliably.

Figure 3:
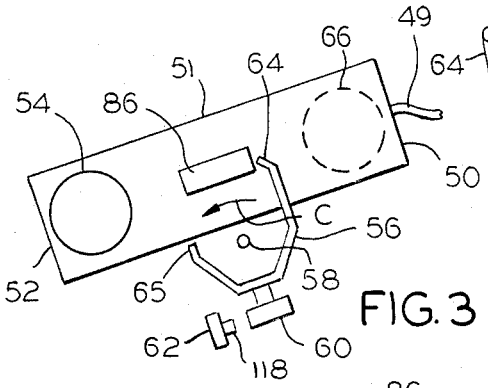
FIGS. 3–5 are three stop motion views showing the principle of the inventive float switch.
Figure 4:
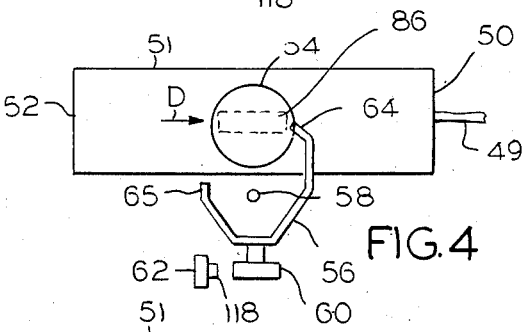
Figure 5:
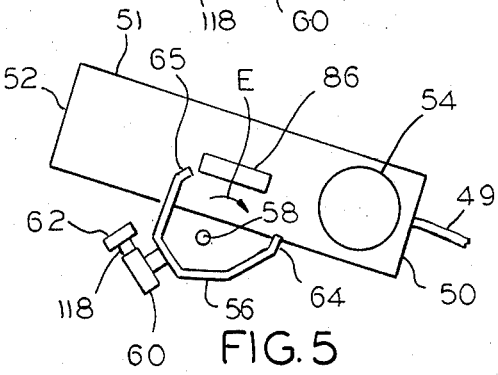

The inventive principle of the presently disclosed device is illustrated in FIGS. 3–5, which in the preferred embodiment discloses a ball race-switch combination enclosed in a float which is connected to the operating mechanism of a sump pump. However, it is to be understood that the ball race-switch mechanism disclosed herein may have application to other attitude responsive switch operated devices. When the water level is low, the tether 49 holds up a proximal end 50 of the ball race 51 and the other distal end 52 of the race hangs down to the low level of the wafer (FIG. 3). A ball 54 made of steel or another suitable heavy material is positioned near distal end 52 of race 51. A ball cage 56 (to be described in more detail) is in a position to be engaged by ball 54 when the attitude of the float switch and race 51 changes. Ball cage 56 is constructed to pivot about axis 58 in the direction shown by the arrow C. In the position shown in FIG. 3, actuator 60 is attached to ball cage 56, and is disposed at a distance from miniature switch 62, thereby leaving miniature switch 62 in its open or "off" position. The position of the race 51 shown in FIG. 3 illustrates the attitude of the race when the water level to be monitored is low, and there is no need to activate the power device of the sump pump.

So the water level being monitored increases, the attitude of race 51 will change. FIG. 4 illustrates the attitude of race 51 as the race approaches horizontal, and ball 54 commences to move under the influence of gravity in the direction shown by the arrow D. The ball 54 engages ball cage 64, causing the ball cage to pivot about axis 58, until it reaches the position shown in FIG. 5, wherein the water has risen to the level where the tether 49 holds down proximal end 50 of race 51 while the float raises distal end 52. When this happens, the ball 54 completely rolls through the ball cage 56 under the influence of gravity to the downwardly extending proximal end 50. Ball cage 56 pivots completely about axis 58 and rotates in direction E (FIG. 5). This moves actuator 60 toward miniature switch 62 and enables it to operate, completing the electrical circuit controlling operation of the sump pump motor.

When the switch 62 operates, the pump switches on and draws down the water until the float returns to the low attitude of FIG. 3, ball cage 56 again rotates about axis 58, in direction C, and miniature switch 62 opens the circuit to the pump. There is an advantage in the device of FIGS. 3–5 since the ball merely rolls through a tubular race 51. It's movement through the race 51 is not affected by the angular orientation around the polar axis of the tubular cross section formed by the race 51. In the device of FIG. 2, the common plane of race 42 must always be vertically oriented, as seen in the figure.

A difficulty with the simple tube and ball cage of FIGS. 3, 4, and 5 is that if the ball and ball cage lose any synchronism, it could become possible for the ball to become trapped between ball cage 56 and the end of the tube, as shown by the ball 66 in dashed lines (FIG. 3). When this happens, the elevated end 64 of ball cage 56 prevents the ball from rolling down to the solid line position 54 on the low water level attitude.

As seen in FIGS. 6–9B, the invention provides a fail safe condition which prevents this ball entrapment, represented by dashed lines in FIG. 3. In greater detail, the ball cage 56 (FIGS. 6–9B) is a molded plastic part having two projecting stops 68, 70 which engage an adjacent part (114, FIGS. 10, 11) of the float housing, thereby limiting the rotary ball cage movements in directions C and E. The outside of the ball cage 56 has shoulders 72, 74, 78 formed thereon with two spaces between them. Therefore, when another part 76 is positioned in either of the spaces between the shoulders, the ball cage 56 is positively prevented from rotating about the axis 58. When the part 76 is removed, the ball cage may rotate between the positions of FIGS. 6, 7. After ball cage 56 reaches one of these positions, the part 76 returns under spring bias to a locking position between the shoulders 72, 74, 78, as will be described.

Figure 6:
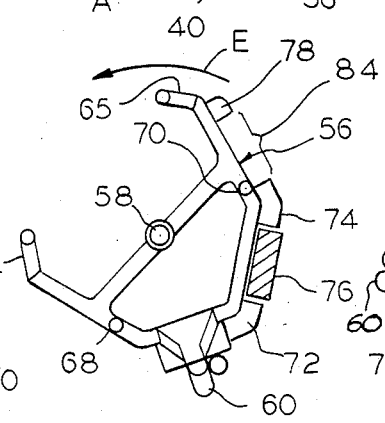
FIGS. 6–7 are front elevations showing the inventive bistable action ball cage part, in its two over center switch operating positions.
Figure 7:
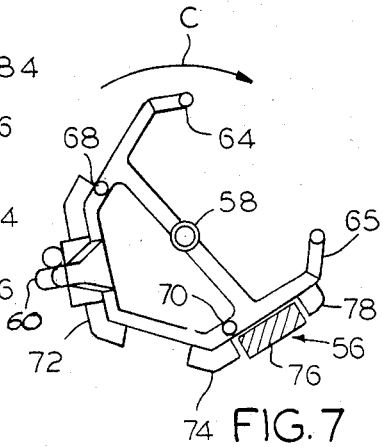
Figure 8:
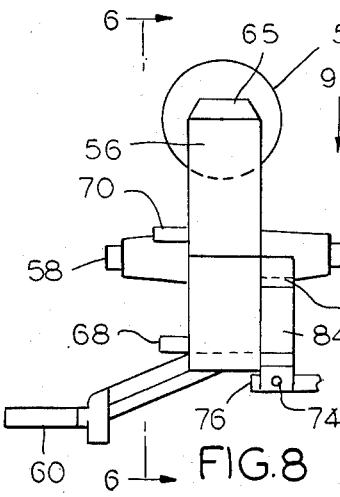
FIG. 8 is a side elevation of the same bistable action part that is seen in FIGS. 6, 7.
Figure 9A:
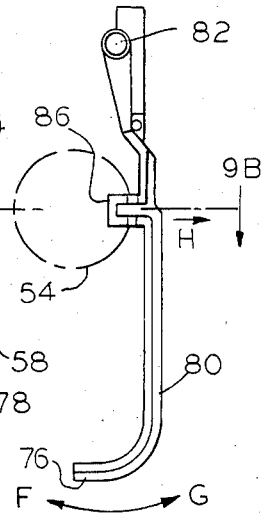
FIG. 9A is a side elevation of a safety lever arm for preventing a stuck ball responsive to an incorrect sequence of the ball positioning and the bistable action of the ball cage.

FIG. 8 is a side elevation of the ball cage 56 which is seen in front elevation in FIGS. 6, 7. FIG. 9A is positioned, relative to FIG. 8, so that these two figures together constitute an exploded view.

Figure 9B:
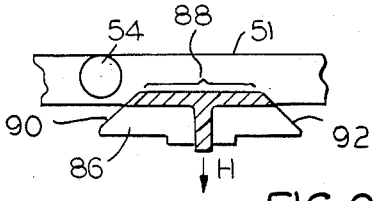
FIG. 9B is a cross section taken along line 9B—9B of FIG. 9A.

FIGS. 9A and 9B shows a safety lever 80 which is pivoted at 82, to swing back and forth in directions F and G. FIG. 8 has been drawn to show a fragment of end 76 in place between shoulders 72, 74 (also seen in FIG. 6). FIG. 8 also shows a space 84, between shoulders 74, 78 for receiving the end 76, when ball cage 56 is in the position shown in FIG. 7.

The ball 54 is shown in FIG. 8 rolling toward tip end 65 of ball cage 56 (FIG. 6). This means that the ball 54 is leaving the position of FIG. 5 and approaching the ball cage 56. When the float tips downwardly, ball 54 rolls to the lower end (FIG. 3) engaging tip 65 and de-activating the miniature switch 62. On its way, the ball must pass the area 86, which is a detent on the fail safe lever arm 80.

This is seen in FIG. 9A, where the ball 54 is approaching detent operator 86. From FIG. 9B, it is seen that the detent operator has a platform 88 with a ramp 90, 92 on either end. As the ball engages ramp 90, it pushes the detent operator 86 in direction H so that it may roll over the platform 88. This swings arm 80 (FIG. 9A) in direction G, about point 82. After the ball leaves the platform 88 and ramp 92, the arm 88 swings back in direction F. While ball 54 is over platform 88, the tip end 76 is withdrawn from engagement with the ball cage 56, so that the ball cage may shift to its other stable position. After the ball 54 leaves the platform 88, a spring (110, FIG. 10) causes tip end 76 to reengage ball cage 56, so that it cannot thereafter move. This means that the ball and ball cage cannot move out of synchronism with each other.

Figure 10:
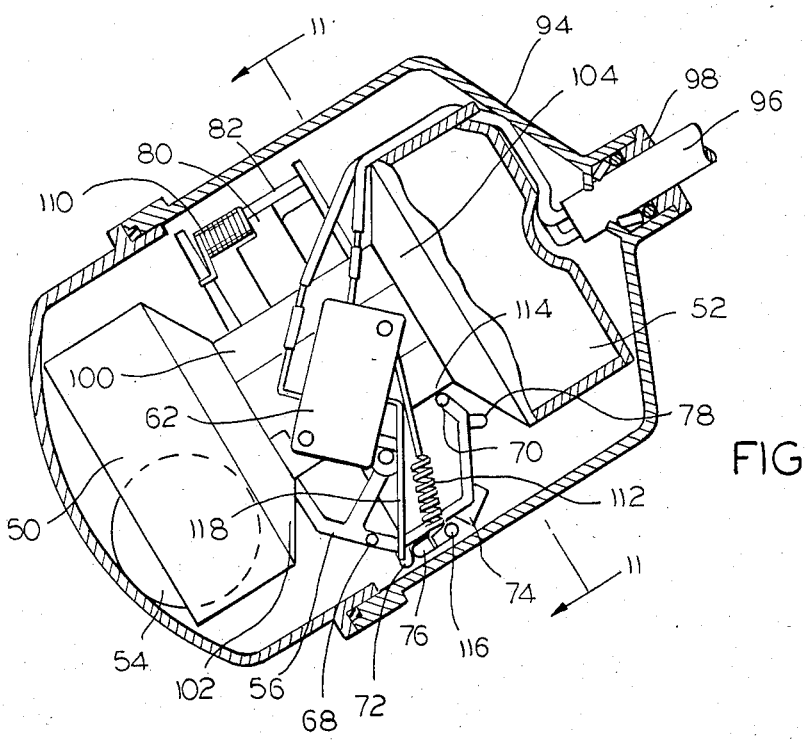
FIG. 10 is a plan view of the assembled inventive float valve.
Figure 11:
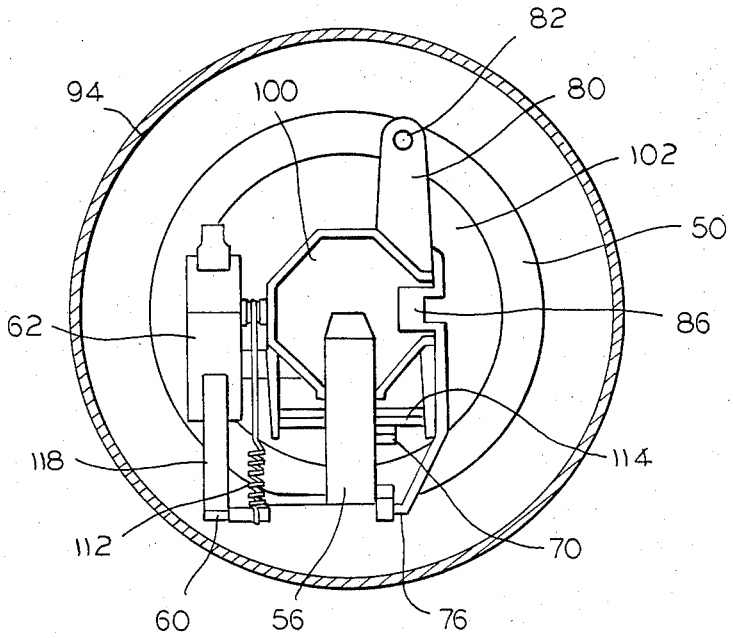
FIG. 11 is a cross section view taken along line 11—11 of FIG. 10.

The operation of the float switch may be explained best with the help of FIGS. 10, 11. The entire unit is hermetically sealed inside a housing 94, which may be covered by rubber or molded plastic, for example. An electrical cord 96 is sealed to the housing 94, at the proximal end 98. The opposite or distal end of housing 94 is free to float on the surface of a liquid. Cord 96 serves the dual function of completing the electrical connections and acting as the tether. The ball race 100 terminates at its opposite ends in somewhat funnel shaped members 102, 104 leading to ends 50, 52 which correspond to the ends 50, 52 of FIGS. 3–5.

Normally, the ball 54 rests in one of the ends 50, 52 until the change in float attitude exceeds some amount predetermined by the angle formed by funnel shaped members 102, 104 and the polar axis of race 100. This allows potential energy to be stored in ball 54, producing a snap action of the ball cage 56. That is, the ball remains where it is until the attitude of the float places it in a position to roll over the hump formed by the funnel sections 102, 104. When this occurs, the race 100 is already tipped far enough so that the ball almost free falls through the race 100 to the other side. As the ball passes through race 100 (FIG. 11), it encounters safety lever detent operator 86 and ball cage 56 in a sequence dictated by the geometry of the parts. Therefore, safety arm 80 swings tip end 76 out of engagement with the ball cage 56, and against the bias of a coiled spring. Note, there is no way for the ball to get behind the wrong ball cage arm to the position shown by the dashed lines in FIG. 3.

As the ball 54 engages the upstanding arm of the ball cage 56, it is flipped to an over center position, which causes the spring 112 to move over center and to snap the ball cage to its other stable position.

If the float switch is in the initial position seen in FIG. 10, the stop 70 is in engagement with a housing part 114, thus limiting ball cage movement. After the float switch operates, the stop 68 engages the housing part 114 to limit movement in that direction. The over center spring 112 holds the ball cage in each of its two positions. As the ball cage 56 rotates, an actuator 60 engages or disengages an arm 118 for operating the miniature switch 62.

The ball 54 and ball cage 56 remains in the new position until the attitude of the float again changes. At that time, the ball rolls back through the race to return the switch to the position seen in the drawings.

It should be noted that the geometry of ends 50, 52 funnel shaped parts 102, 104 and race 100 are symmetrical around the polar axis of the race. There is no up or down. Therefore, it is not important how their attitude may change by rolling around to a different attitude. The only important attitude is whether the tethered end 98 is sufficiently above or below the free end 50 to tip the ball race up or down as shown in FIGS. 3–5. That attitude depends entirely upon the height of the water on which the housing 94 is floating, and the length or distance between the pivot axis and the distal end of the switch housing. Additionally, the shape of race 51 reduces rolling frictional resistance between ball 54 and raceway 51, by providing only two points of contact between ball and raceway.

In FIGS. 10 and 11 of the drawing, ball cage 56 is illustrated as actuating or de-actuating a miniature switch 62. However, it is to be understood that a magnet/reed type switch, an electronic type switch, or any equivalent signal sending or switching mechanism may be used in place of miniature switch 62.

Figure 12:
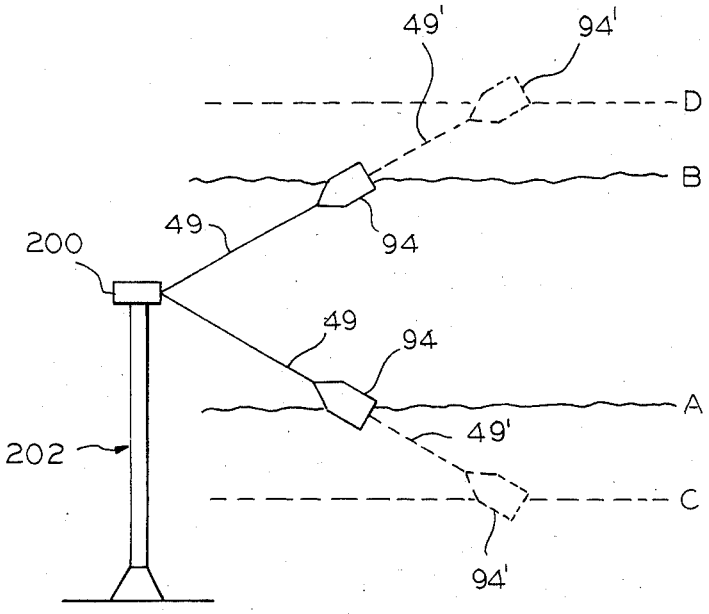
FIG. 12 is a schematic diagram of the present invention illustrating how the length of the tether may be adjusted to vary the "on-off" differential.

FIG. 12 illustrates a further advantage of the present invention. A motor 200 for a sump pump 202 is controlled by a float switch of the type described herein and encased in a water-tight float housing 94. Flexible tether 49 extends between housing 94 and motor 200. The float housing and tether shown by solid lines in FIG. 12 illustrate the upper and lower positions of the float housing when it is desired to control the water between low level A and upper level B. However, if it is desired to change the parameters of pump operation to control the water between levels C and D, all that is necessary is to lengthen the tether, as shown by 49', until the float housing 94' reaches the proper upper and lower levels. It is also possible to control the water level at planes between levels A and B by shortening the length of tether 49.

Since switch 62 is inside the float 94, and not sealed inside the sump pump casing, the switch and its attendant mechanism can readily be serviced if necessary without breaking the seal of the sump pump casing. The disclosed invention can also be produced at a relatively low cost of manufacture.

The disclosed invention has been described as controlling a sump pump motor. However, the novel float switch of the present application can be used in association with any power device which is to be controlled responsive to the change in level of any medium whose level is to be controlled or detected.

Those who are skilled in the art will readily perceive how to modify the invention. Therefore, the appended claims are to be construed to cover all equivalent structures which fall within the true scope and spirit of the invention.

The claimed invention is:

1. A float switch having a distal end and a proximal end, tether means for limiting movement of the proximal end, the distal end being free to float on a surface of a liquid, race means extending within said float switch between said distal and proximal ends, a ball free to roll through said race means, switch means operated by said ball responsive to its rolling through said race means, safety means for maintaining a synchronism between the position of said ball and the operation of said switch means, a ball cage pivoted to rotate between either of two positions responsive to the rolling of said ball within said race, wherein said safety means is a spring biased lever arm which normally engages said ball cage and prevents its movement, said lever arm having a part which is pushed aside by the movement of said rolling ball at a time when said ball cage should pivot, whereby the ball and cage movements are synchronized.

2. The float switch of claim 1 and over center spring means for holding said cage in the last position, to which it was operated.

3. The float switch of claim 2 and means on opposite ends of said race for restraining ambiguous ball movements by preventing the ball from rolling until said race has reached an attitude which insures positive switch operation.

4. A hermetically sealed float switch having a longitudinal axis comprising an elongated housing tethered at one end and otherwise being free to float, whereby the attitude of said housing changes as it floats higher or lower, a ball in an elongated ball race inside said housing, said race being oriented relative to said tether so that said ball rolls from one end to the other end of said race responsive to the attitude of said housing as it floats higher or lower, said race being otherwise symmetrical about said longitudinal axis so that float attitudes other than changes caused by said tether and float level are irrelevant, a ball cage positioned within said race to move between either of two positions responsive to said ball rolling between the ends of said race as said float changes its tether caused attitude, and switch actuator means operated responsive to the movement of said ball cage.

5. The float switch of claim 4 and safety means located within said race and at a position engaged by said ball for locking and unlocking the movement of said ball cage responsive to the rolling of said ball, whereby the sequence of ball and cage movements is controlled.

6. The float switch of claim 4 wherein each of the opposite ends of said race terminates in a cavity coupled to said race via a somewhat funnel shaped member whereby said float must tip by a distance which exceeds horizontal far enough to insure a positive movement of said ball from one end through said race to the other of said ends.

7. A float switch having a longitudinal axis a distal end and a proximal end, tether means for limiting movement of the proximal end, the distal end being free to float on a surface of a liquid, race means extending within said float switch between said distal and proximal ends, a ball free to roll through said race means at all orientations of said float switch, switch actuating means operated by said ball responsive to its rolling through said race, and safety means for maintaining the relative position of said ball and said switch actuating means at all orientations of said float switch by engaging and restraining actuation of said switch actuating means against movement until said safety means has been engaged by said ball.

8. The float switch of claim 7 and a ball cage pivoted to rotate between either of two positions responsive to the rolling of said ball within said race, said switch means operated in response to movement of said ball cage.

9. The float switch of claim 8 and means on opposite ends of said race for restraining ambiguous ball movements at all orientations of said float switch about its axis by preventing the ball from rolling until said race has reached an attitude which insures positive switch operation.

10. A switch capable of movement from an actuating position to a de-actuating position including: a housing, a raceway in said housing along which a ball travels from one end to the other as the attitude of the raceway changes, a ball cage in said housing operatively connected to said switch and adapted to be engaged by said ball at all orientations of said raceway as said ball travels along said raceway, whereby said ball cage moves between a first position to actuate said switch and a second position to de-actuate said switch responsive to said ball engaging said ball cage during the movement of said ball along said raceway.

11. The switch of claim 10 further including safety means releasably engaging said ball cage to prevent movement of said ball cage between said first and second positions until said ball reached a pre-determined location as it moves along said raceway and engages said safety means.

12. A switch capable of movement from an actuating position to a de-actuating position including: a raceway along which a ball travels from one end to the other as the attitude of the raceway changes, a ball cage operatively connected to said switch and adapted to be engaged by said ball as said ball travels along said raceway, whereby said ball cage moves between a first position to actuate said switch and a second position to de-actuate said switch as said ball engages said ball cage during the movement of said ball along said raceway, safety means to prevent movement of said ball cage between said first and second positions until said ball reaches a pre-determined location as it moves along said raceway, wherein said safety means includes a ramp having a platform thereon to engage and be moved by contact with said ball, means associated with said ramp engaging and preventing movement of said ball cage when in a first position and out of engagement and permitting movement of said ball cage when in a second position, whereby contact by said ball with said platform means moves said safety means from said first position to said second position.

13. The switch of claim 12 wherein said safety means is biased to return to said first position when said ball is no longer in contact with said platform as said ball travels along said raceway.

14. A switch capable of movement from an actuating position to a de-actuating position having a mechanically operated switch element, said switch including: a raceway along which a ball travels in one of two directions as the attitude of said raceway changes; ball capturing means extending into said raceway and disposed in the path of said ball as said ball travels along said raceway; said ball capturing means adapted to capture and releasably hold said ball as said ball moves on said raceway, said ball adapted to move said ball capturing means between a first position to operate said switch element to actuate said switch and a second position to operate said switch element to de-actuate said switch.

15. A float switch having a distal end and a proximal end, tether means for limiting movement of the proximal end, the distal end being free to float on a surface of a liquid, race means extending within said float switch between said distal and proximal ends, a ball free to roll through said race means, switch means operated by said ball responsive to its rolling through said race means, safety means for maintaining a synchronism between the position of said ball and the operation of said switch means, a ball cage pivoted to rotate between either of two positions responsive to the rolling of said ball within said means, and over center spring means for holding said ball cage in the last position to which it was operated.

16. A hermetically sealed float switch comprising an elongated housing tethered at one end and otherwise being free to float, whereby the attitude of said housing changes as it floats higher or lower, a ball in an elongated ball race inside said housing, said race being oriented relative to said tether so that said ball rolls from one end to the other end of said race responsive to the attitude of said housing as it floats higher or lower, said race being otherwise symmetrical so that float attitudes other than changes caused by said tether and float level are irrelevant, a ball cage positioned within said race to move between either of two positions responsive to said ball rolling between the ends of said race as said float changes its tether caused attitude, and switch means operated responsive to the movement of said ball cage, each of the opposite ends of said race terminating in a cavity coupled to said race via a somewhat funnel shaped member whereby said float must tip by a distance which exceeds horizontal far enough to insure a positive movement of said ball from one end through said race to the other of said ends, and safety means located within said race and at a position engaged by said ball for locking and unlocking the movement of said ball cage in response to the rolling of said ball, whereby the sequence of ball and cage movements is controlled, said safety means located within said race comprising a platform with a ramp on opposite sides to guide said ball to allow said ball to operate said safety means.

17. A hermetically sealed float switch comprising an elongated housing tethered at one end and otherwise being free to float, whereby the attitude of said housing changes as it floats higher or lower, a ball in an elongated ball race inside said housing, said race being oriented relative to said tether so that said ball rolls from one end to the other end of said race responsive to the attitude of said housing as it floats higher or lower, said race being otherwise symmetrical so that float attitudes other than changes caused by said tether and float level are irrelevant, a ball cage positioned within said race to move between either of two positions responsive to said ball rolling between the ends of said race as said float changes its tether caused attitude, switch means operated responsive to the movement of said ball cage, safety means located within said race and at a position engaged by said ball for locking and unlocking the movement of said ball cage responsive to the rolling of said ball, whereby the sequence of ball and cage movements is controlled, and bistable action means for holding said ball cage in the last position to which it moved in response to the rolling of said ball.

* * * * *